United States Patent [19]

Ramqvist et al.

[11] 4,013,487

[45] Mar. 22, 1977

[54] NICKEL AND/OR COBALT-COATED STEEL WITH CARBURIZED INTERFACE

[75] Inventors: Lars H. Ramqvist; Nils Olle Grinder; Malte Sporrong, all of Nynashamn; Per Enghag, Garphyttan, all of Sweden

[73] Assignee: Rederiaktiebolaget Nordstjernan, Sweden

[22] Filed: Mar. 4, 1975

[21] Appl. No.: 555,108

[30] Foreign Application Priority Data

Mar. 14, 1974 Sweden ..... 7403411

[52] U.S. Cl. ..... 148/16.5; 29/196.6; 148/31.5; 204/38 R; 427/405; 427/406

[51] Int. Cl.[2] ..... C23C 11/12; C25D 5/50

[58] Field of Search ..... 148/16.5, 31.5, 143, 148/39; 29/195, 196.6; 204/37 R, 38 R; 427/405, 406

[56] References Cited

UNITED STATES PATENTS

| | | | |
|---|---|---|---|
| 1,978,180 | 10/1934 | Weiller | 148/16.5 |
| 1,984,411 | 12/1934 | Holt | 148/16.5 |
| 2,294,562 | 9/1942 | Kingston | 148/16.5 |
| 2,315,740 | 4/1943 | Schoonmaker | 204/37 R |
| 3,206,324 | 9/1965 | Daesen | 427/406 X |
| 3,647,572 | 3/1972 | Todd et al. | 148/16.6 |
| 3,668,951 | 6/1972 | Talmage | 148/16.5 |
| 3,769,084 | 10/1973 | Saito et al. | 204/38 R |

FOREIGN PATENTS OR APPLICATIONS

| | | | |
|---|---|---|---|
| 345,659 | 3/1931 | United Kingdom | 204/37 R |
| 380,882 | 9/1932 | United Kingdom | 204/37 R |

*Primary Examiner*—C. Lovell

*Attorney, Agent, or Firm*—Hopgood, Calimafde, Kalil, Blaustein and Lieberman

[57] ABSTRACT

A case-hardened, corrosion-resistant steel article is provided which comprises, applying a coating of nickel and/or cobalt to the surface of the article and then subjecting said coated article to carburization by heating said coated article to and maintaining it at an austenitic temperature under carburizing conditions for a time sufficient to effect carbon diffusion into the surface of the steel article. The corrosion resistance of the steel may be further enhanced by applying a thin layer of a final metal coat selected from the group consisting of Cr, Sn, Pb, Zn, Cu and Cd.

5 Claims, No Drawings

NICKEL AND/OR COBALT-COATED STEEL WITH CARBURIZED INTERFACE

This invention relates to a process for producing a nickel and/or cobalt coated carburized steel having improved resistance to corrosion and improved physical properties.

STATE OF THE ART

Case hardening is a method of hardening the surface and sub-surface of a steel substrate by heating the steel at an austenitizing temperature in a carburizing atmosphere wherein carbon diffuses into the steel surface to harden it while the carbon content of the core remains unaltered. Thus, the interior of the steel is tough while the outside surface is hard.

The case hardening technique is used in the manufacture of rock drills, plate screws, wear elements, and the like. Generally, because of the greater surface hardness, the risk of mechanical failure increases. This is particularly the case where failure by mechanical rupture is initiated by surface corrosion. The failure of rock drills by surface corrosion is not uncommon.

In the case of rock drills, corrosion is most apt to occur in the interior flush holes of drill rods due to acidified water which generally contains a suspension of hard particles, e.g. fine sand and the like, the particles having an erosive effect on the flush hole. Such erosion attack can lead to premature fatigue failure.

It is known to coat steel articles, such as steel bands, wires, pipes or plates with a thin layer of nickel or cobalt. This process has been widely used for increasing resistance to corrosion attack. However, if the coated layer of nickel or cobalt breaks or flakes off, it no longer protects the steel substrate against corrosion.

It is also known that steel objects coated electrolytically or chemically with a surface layer of nickel and cobalt can be hardened after application of this surface layer by heating the steel to a temperature range at which austenite forms and by rapidly cooling said steel to form a martensitic structure. It has been found that the surface layer is not damaged by the hardening treatment and that adequate protection against corrosion is maintained while, at the same time, improving the strength properties of the substrate.

It is further known that neither nickel nor cobalt forms carbides easily. Moreover, it is known to use fairly thick coatings of nickel and cobalt as diffusion barriers for carbon, especially in the preparation of certain composite steel plates comprising, for example, stainless steel bonded to a carbon steel substrate.

With regard to further prior art, reference is made to U.S. Pat. No. 2,294,562 (dated Sept. 1, 1942) which discloses a method for forming carbonized steel strip for use in electron discharge tubes. The carbon layer forms an appreciable percentage of the cross-sectional thickness, the purpose of the carbonized layer being that the material will have a smaller secondary electron emission as compared to a bright or undarkened steel surface. The method comprises nickel plating steel, oxidizing the nickel plate and then simultaneously reducing the oxide and carbonizing the steel at a temperature sufficient to form a pearlitic layer in the matrix with a carbonized surface thereover. The resulting article has a carbon outer surface desired for electronic use and a sub-surface of pearlite, the center core of the strip being substantially ferrite to provide the necessary ductility so that the strip can be deformed by bending without cracking the surface.

It has now unexpectedly been found that it is possible to carburize steel without carbonizing the surface in spite of the fact that there is a metallic nickel or cobalt layer on the surface of the steel. There is need for such a carburization process in cases where a tough basic material is required having improved strength properties as well as improved protection against corrosion.

OBJECTS OF THE INVENTION

It is thus an object of the invention to provide a carburized nickel and/or cobalt steel article characterized by improved resistance to corrosion and improved physical properties.

Another object is to provide a process for producing a carburized nickel and/or cobalt coated steel article characterized by improved resistance to corrosion and improve physical properties.

A further object is to provide a process for producing a carburized nickel and/or cobalt coated steel article in which an additional coating metal is applied to the nickel or cobalt layer to further improve the corrosion resistance of said article.

These and other objects will more clearly appear when taken in conjunction with the following disclosure and the appended claims.

STATEMENT OF THE INVENTION

In its broad aspects, the invention is directed to a process for treating steel articles to improve the physical properties thereof and resistance to corrosion, wherein a steel article is coated with a surface layer of nickel and/or cobalt and then heat treated at an elevated austenitizing temperature under carburizing conditions for a time sufficient to effect carburization of the steel surface underneath the nickel and/or cobalt coating.

By utilizing the invention, a two-fold effect is obtained, to wit: (1) the metal coating is adherently bonded to the steel surface and (2) the steel surface is carburized to raise the hardness thereof relative to the lower core hardness of the steel article.

Another advantage of the invention is that following the carburizing heat treatment, the article may be rapidly cooled from the austenitizing temperature to produce a martensitic structure in at least one zone of the carburized steel article or object.

Still another advantage is that the carburized coated steel can be further improved as to corrosion resistance by applying a coating of a metal from the group consisting of Cr, Zn, Pb, Zn, Cu and Cd.

Steel articles or objects, which can be coated with nickel and/or cobalt and then carburized and hardened, may have any arbitrary shape and composition capable of being hardened, for example, with the carbon content of the steel substrate ranging up to 0.5%, e.g. 0.05 to 0.4% carbon by weight. It has been found possible with the present invention to case harden a variety of articles, including finished elements, such as bolts, screws, rock drills, including extension rods, and the like, following coating with nickel and/or cobalt.

The layer of nickel and/or cobalt on the steel object can be applied in a conventional manner chemically or electrolytically. The carburization of nickel or cobalt coated steel objects according to the present invention can be carried out in the known manner by heating the coated steel object to an austenitizing temperature and maintaining it at said temperature in a carbon donating atmosphere (e.g. under carburizing conditions) for a time sufficient to effect carburization of the surface zone of the steel object by diffusion. A desirable carburization depth may be at least about 0.1 mm (e.g. at least about 0.004 inch). The carburization may be achieved by embedding the steel object in carbon and/or other substances promoting carbon absorption, e.g. barium carbonate or soda, or by means of carburizing gases, such as carbon monoxide or hydrocarbons, or a mixture of methane and ammonia.

By carrying out the heat treatment at the austenitizing temperature, a good bond between the surface layer of nickel and/or cobalt and the steel object is obtained at the same time as the carbon penetrates the nickel- and/or cobalt-layer and diffusing into the steel surface. As indicated above, the carbon penetration through the metal coating is unexpected. Heat treatment temperatures in excess of 725° C should be employed. The austenitizing temperature should preferably be between 800° and 1000° C.

If it is desired to harden the object, this can be done in combination with the carburizing heat treatment by rapidly cooling the object following carburization, e.g. by quenching in water, oil, air or in a manner to form a martensitic structure at least in the carburized layer in the steel object. However, hardening need not be carried out immediately after carburization but the object can be cooled more slowly, for example, furnace cooled, in order to be reheated later and rapidly cooled for hardening, for example, water quenching, where the carbon content is about 0.3% C or below and oil quenching for carbon content of about 0.5% by weight. If it is desirable, hardening may be followed by tempering in the known manner. Details of carburizing, martenizing and tempering are well known in the art and need not be repeated here.

Tests have shown that a nickel layer having a thickness of about 10–20 microns, can decrease the carburizing effect by a half, as compared to a non-coated steel, but the carburization effect is sufficient to be of great commercial importance in many cases. The nickel and/or cobalt layer is preferably at least about 5 microns, the maximum thickness being determined by economics. Examples of the use of the foregoing is the manufacture of rock drills, with particular reference to the interior flush holes of the drilling rod which, as stated hereinabove, are subject to corrosion and erosion. Such attack can cause premature fatigue failure. The problems of corrosion and fatigue failure also exist at the outer surface of the drill, even if these problems are not as manifest as at the interior flush hole. According to the invention, such rock drills can be provided with a layer of nickel internally as well as externally and then be carburized and hardened. To further augment the resistance to corrosion, the finished part may be optionally plated with a metal from the group Cr, Sn, Pb, Zn, Cu and Cd.

As stated hereinabove, the nickel and/or cobalt layer may be at least about 5 microns and, preferably, range from approximately 5 to 15 or 20 microns in order to assure optimum improvement of the physical properties of the material. Layers having a thickness of less than 1 micron do not provide the desired improvements in corrosion resistance, whereas, layers with a thickness of more than 15 microns tend to impede the carburization rate of the steel surface. However, higher thicknesses can be employed; therefore, a balancing between the desired protection against corrosion and the desired strength should be made in each specific case.

High carbon activity-potential is essential in the carburizing zone when carburizing steel. This generally results in carbon deposits directly on the steel surface as well as on furnace parts. However, the amount deposited on nickel-coated steel is much less. The carbon deposited on the nickel adheres rather weakly and, therefore, is very easy to clean off the surface, for example, by pickling in a hydrocholoric acid solution for 1 to 2 minutes. This is because nickel does not readily form carbides.

However, carbon deposited on steel surfaces during carburization is difficult to remove either by pickling or by polishing. Usually, pickling times of up to 20 or 30 minutes are required to obtain a fairly clean surface. This can result in considerable hydrogen absorption by the steel which can lead to hydrogen embrittlement. In the case of the carburized nickel-coated steel, there is substantially little or no hydrogen absorption as the pickling time is very short and, besides, very little hydrogen is liberated as the nickel is not attached by the hydrochloric acid to any great extent.

It is not always possible to remove deposited carbon entirely from steel surfaces, due to deposits remaining in crevices or cracks in the surface. Therefore, a metal coating deposited on the steel surface following carburizing and cleaning, e.g. Sn, Cd and the like, may not adhere properly and thus may not provide the desired protection against corrosion.

An important application of the invention is in self-tapping screws which normally are coated with zinc or cadmium to decrease friction when the screws are tapped into the receiving hole. However, carburized screws without the nickel precoat tend to exhibit high friction during insertion due to the presence of deposited carbon in the threads.

Carburized and high carbon steels are sensitive to stress-corrosion cracking and hydrogen embrittlement. However, the application of a nickel coat prior to carburizing is further advantageous in that the nickel layer after the carburizing heat treatment step is soft and stress-face which is important in avoiding cracking at the surface of the carburized steel. This attribute results in markedly improved physical properties according to the invention.

As illustrative of one embodiment of the invention, the following example is given.

EXAMPLE 1

Two similar steel articles containing about 0.1% carbon by weight are surface coated electrolytically with nickel and cobalt, respectively, to a thickness of about 10 microns. The nickel coating is applied to the steel surface by using the following bath (Watts Bath) containing about 240 to 340 gpl $NiSO_4.7H_2O$, about 30 to 60 gpl $NiCl_2.6H_2O$ and about 30 to 40 gpl $H_3BO_3$ at a current density of about 1 amp/dm$^2$ for 55 minutes. The cobalt is applied from an electrolytic bath (pH = 3 to 5) containing about 330 to 565 gpl $CoSO_4.7H_2O$, about 30 to 45 gpl $H_3BO_3$, 0 to about 45 gpl $CoCl_2.6H_2O$, optionally 17 to 25 gpl of NaCl or KCl at a current density of about 2.15 to 5 amps/dm$^2$ for 16 minutes.

Following plating of each steel article, the articles are carburized in a furance at about 880° C for 1.5 hours in an atmosphere containing 10% by volume of methane and 90% by volume of nitrogen. Following completion of the heat treatment, the carburized zone in each case ranges from about 0.10 to 0.15 mm (about 0.004 to 0.006 inch). The Rockwell hardness ($R_C$) is about 45 at the surface and about 37 to 38 in the core. The steel carburized in accordance with the invention exhibits improved resistance to corrosion.

For comparison, the same steel article is carburized in the same manner without the metal coatings to provide a carburized zone of about 0.10 to 0.23 mm thick (about 0.004 to 0.009 inch), with $R_C$ hardness more than about 45. On the other hand, the core hardness ranges from about 28 to 38 $R_C$. However, the conventionally carburized steel exhibits inferior resistance to corrosion.

Various other plating baths may be employed for producing a substantially continuous Ni and/or Co coating on steel articles. Examples of such baths are as follows:

| | | |
|---|---|---|
| Sulphamate solution | | |
| Nickel sulphamate | $Ni(NH_2SO_3)_2$ | 300 g/l |
| Nickel chloride | $NiCl_2.6H_2O$ | 30 g/l |
| Boric acid | $H_3BO_3$ | 30 g/l |

pH 3.5 – 4.5
Temperature 25° to 70° C
Cathodic current density 2–14A/dm²

| | |
|---|---|
| Electroless nickel coating | |
| Nickel chloride | 30 g/l |
| Sodium hypophosphite | 10 g/l |
| Ammonium citrate | 65 g/l |
| Ammonium chloride | 50 g/l |
| pH | 8 – 10 |
| Temperature | 80 – 90° C |
| Electroless cobalt coating | |
| Cobalt chloride | 30 g/l |
| Sodium hypophosphite | 20 g/l |
| Sodium citrate | 35 g/l |
| Ammonium chloride | 50 g/l |
| pH | 9 – 10 |

Examples of various methods for carburizing steel are given on pages 677–697 of the *ASM Metals Handbook* (1948 Edition). Methods for electroplating nickel and/or cobalt are given on pages 87–140, respectively, and pages 141–147 of the book *Handbuch der Galvanotechnik*, Bank II, H. W. Dettner und J. Elze, Carl Hanser Verlag (1966) Munchen.

As stated hereinbefore, it may be preferred, depending on the end use of the nickel and/or cobalt-coated carburized steel article, to further improve the corrosion resistance thereof. Thus, to the surface coating of nickel and/or cobalt following carburization and the cleaning of the surface, an additional thin layer of one or more of the metals Cr, Sn, Pb, Zn, Cu and Cd may be applied. The layer can be applied in the conventional manner, e.g. by electrolysis, by chemical deposition, by metal spraying and the like, all well known to those skilled in the art.

Thus, in one embodiment involving carbon steel bolts (e.g. 0.3% C by weight), a 10 micron nickel plate is applied to the bolts, the bolts carburized in accordance with the invention and, after cleaning in the known manner, coated with another metal from the group consisting of Cr, Sn, Pb, Zn, Cu and Cd as follows:

The bolts are coated with a 10 micron zinc layer electrolytically by using a bath consisting 15 to 20 gpl (grams per liter) zinc, 25 to 45 gpl of sodium cyanide and 80 gpl and 80 gpl NaOH, with the plating carried out at a density of about 1 amp/dm² for 60 minutes at room temperature.

In the alternative, a lead coating may be employed in place of zinc using, for example, a bath containing 110 to 165 gpl lead, 50 to 100 gpl free sulfamic acid at a pH of about 1.5, a current density of 0.5 to 4 amps/dm² and a temperature of 24° to 50° C. The known lead fluosilicate baths may also be employed.

A cadmium overcoat may similarly be applied to the nickel and/or cobalt layer. A typical barrel plating bath is one containing 15 to 20 gpl Cd and 70 to 90 gpl NaCN. An average effective current density is one ranging from about 1.5 to 2 amps/dm² at a temperature of 20° to 35° C.

The plating conditions as to the remaining class of coating metals referred to hereinabove are well known and need not be repeated here. The coating thickness of the metals Cr, Sn, Pb, Zn, Cu and Cd may be at least about 2 or 3 microns. The thickness may range upwards to about 20 microns or even up to 30 microns or more depending upon economic considerations. A preferred range is about 5 to 20 or 30 microns.

The following illustrates the further improvements which are obtainable by superposing the nickel layer with an additional metal coating as described hereinabove. Comparison is made with a typical prior art process as follows:

EXAMPLE 2

| Prior Art | According to the Invention |
|---|---|
| Steel part | Steel part |
| | Pickling |
| | Nickel plating |
| Carburization | Carburization |
| Quenching | Quenching |
| Tempering | Tempering |
| Degreasing | Degreasing |
| Pickling (HCl, 25° C) | Pickling |
| Zinc coating | Zinc coating |

Carbon steel screws (about 0.18%C by weight) measuring 40 mm long by 8 mm diameter were treated form the viewpoint of corrosion resistance as follows. 10 screw samples were carburized and zinc-coated using the prior art method outlined above and 10 screw samples nickel plated, carburized and zinc-coated using the invention. A neutral salt spray test (salt spray fog) based on ASTM B-117 was employed in determining resistance to corrosion. The results are given as follows:

| Prior Art | | Invention | |
|---|---|---|---|
| Carburized | | 10 micron nickel plate and carburized | |
| 10 micron zinc coating | | 10 micron zinc coating | |
| TIME TO RED RUST | | TIME TO RED RUST | |
| 4 samples | 40 hours | 4 samples | 180 hours |
| 2 samples | 60 hours | 3 samples | 200 hours |
| 3 samples | 80 hours | 2 samples | 220 hours |
| 1 sample | 100 hours | 1 sample | 240 hours |

EXAMPLE 3

Screws the same as those of Example 2 were subjected to a life test under stress while being subjected to the same salt spray test, the screws being stressed to 90% of the yield strength along the screw axis. This test measures in effect the sensitivity to stress-corrosion cracking and hydrogen embrittlement. The screws had a final coat of cadmium. The results obtained are as follows:

| Prior Art | Hours to Failure |
|---|---|
| Carburized + 10 micron Cd | 70 |
| Carburized + 10 micron Ni | 10 |
| Invention | |
| 10 micron Ni + carburized + 10 micron Cd | No failure after 1000 hours |

As will be observed, the system Ni-carburization-Cd provides markedly superior results on the stress-life test.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for producing a corrosion resistant carburized steel article which comprises, applying a first metal coating comprising a layer of metallic nickel and/or cobalt of thickness ranging from about 5 to 20 microns to the surface of said steel article having a carbon content ranging up to about 0.5% by weight, carburizing said metal coated steel at an austenitizing temperature ranging from about 800° to 1000° C for a time sufficient to produce a carburized zone of thickness at least about 0.1 mm beneath said metal coating, rapidly cooling said article from its austenitizing temperature to produce a martensitic structure in at least said carburized zone, and then applying to said nickel and/or cobalt layer a second metal coating of over 2 microns thick of a metal selected from the group consisting of Cr, Sn, Pb, Zn, Cu and Cd, said nickel and/or cobalt layer having been cleaned of any deposited carbon formed thereon during the carburization step, whereby said article is characterized by an adherent first metal coating bonded to said steel and a second metal coating covering said first metal coating, said article being characterized further by improved resistance to corrosion and improved physical properties.

2. The process of claim 1, wherein the second metal coating has a thickness ranging from about 5 to 30 microns.

3. The process of claim 1, wherein the first metal coating is nickel and the second metal coating is zinc.

4. The process of claim 1, wherein the first metal coating is nickel and the second metal coating is cadmium.

5. A corrosion resistant carburized steel article produced in accordance with the process of claim 1.

* * * * *